US005742467A

United States Patent [19]

Schmitz

[11] Patent Number: 5,742,467

[45] Date of Patent: Apr. 21, 1998

[54] METHOD OF CONTROLLING ARMATURE MOVEMENT IN AN ELECTROMAGNETIC CIRCUIT

[75] Inventor: Günter Schmitz, Aachen, Germany

[73] Assignee: FEV Motorentechnik GmbH & Co. KG, Aachen, Germany

[21] Appl. No.: 535,931

[22] Filed: Sep. 28, 1995

[30] Foreign Application Priority Data

Sep. 28, 1994 [DE] Germany ..... 44 34 684.0

[51] Int. Cl.[6] ..... H01H 47/00

[52] U.S. Cl. ..... 361/154; 361/191

[58] Field of Search ..... 361/154, 187, 361/191

[56] References Cited

U.S. PATENT DOCUMENTS

| | | | |
|---|---|---|---|
| 3,786,314 | 1/1974 | Misch | 361/154 |
| 4,292,658 | 9/1981 | Locher | 361/187 |
| 4,399,483 | 8/1983 | Phelan | 361/154 |
| 4,455,543 | 6/1984 | Pischinger et al. | 335/266 |
| 4,656,400 | 4/1987 | Pailthorp et al. | 361/154 |
| 4,665,348 | 5/1987 | Stupak, Jr. | 361/154 |
| 4,885,658 | 12/1989 | Buchl | 361/154 |
| 5,131,624 | 7/1992 | Kreuter et al. | 251/129.18 |
| 5,241,218 | 8/1993 | Page | 361/154 |
| 5,293,551 | 3/1994 | Perkins et al. | 361/154 |

FOREIGN PATENT DOCUMENTS

| | | |
|---|---|---|
| 0 264 706 | 10/1990 | European Pat. Off. . |
| 0 405 189 | 9/1993 | European Pat. Off. . |
| 30 24 109 | 9/1989 | Germany . |

*Primary Examiner*—Jeffrey A. Gaffin
*Assistant Examiner*—Thuy-Trang N. Huynh
*Attorney, Agent, or Firm*—Spencer & Frank

[57] ABSTRACT

A method of controlling movements of an armature in an electromagnetic circuit which includes at least one holding solenoid applying magnetic forces to the armature and at least one resetting arrangement for applying a resetting force to the armature. The method includes the following cyclical steps: switching on a holding current to flow through the solenoid for holding the armature at the solenoid; after a predetermined period, switching off the holding current for causing the armature to begin a motion away from the solenoid; after switch-off of the holding current detecting, across the solenoid, a voltage change caused by the displacement of the armature for recognizing a starting moment of armature motion from the solenoid; and deriving a control signal from signals representing the voltage change ascertained in the course of the detecting step.

5 Claims, 7 Drawing Sheets

METHOD OF CONTROLLING ARMATURE MOVEMENT IN AN ELECTROMAGNETIC CIRCUIT

CROSS REFERENCE TO RELATED APPLICATION

This application claims the priority of German Application No. P 44 34 684.0 filed Sept. 28, 1994, which is incorporated herein by reference.

BACKGROUND OF THE INVENTION

This invention relates to a method for controlling the movement of an armature forming part of an electromagnetic circuit which has at least one armature holding magnet and at least one armature resetting means.

Electromagnetic circuits of the above outlined type are used, for example, for controlling the intake and/or outlet valves in internal combustion engines to achieve an adaptable control for the intake and exhaust gases so that the combustion process may be optimally influenced in accordance with momentary requirements. The course of the control has a significant effect on the various parameters, for example, the condition of the working medium in the intake zone, in the work chamber and in the exhaust zone, the operating frequency and the occurrences in the work chamber itself. Since internal combustion engines operate in a varying manner under widely changing operational conditions, a variable positive control of the valves is of advantage. Such an electromagnetic circuit for internal combustion engine valves is described, for example, in German Patent No. 3,024,109.

A significant problem in the control of the above outlined electromagnet circuits, particularly when used for controlling the setting members in an internal combustion engine, such as the intake and exhaust valves, resides in the accuracy of timing required particularly for the intake valves in the control of engine output. An accurate time control is rendered difficult by manufacturing tolerances, by wear appearing during operation and by the various operational conditions, for example the changing operating frequencies for the reason that these external parameters may effect time-relevant parameters of the system.

A significant problem in the above-outlined electromagnet circuit arrangements is the appearance of the sticking (adhering) of the armature to the holding magnet. Such a sticking is caused essentially by eddy currents in the magnetic circuit. The sticking time (duration of adherence) depends from a number of different parameters such as the size of the air gap, the force of the resetting means (mechanical springs, as a rule) and the gas counter pressure in case of gas control valves. In addition to the unavoidable manufacturing tolerances, in electromagnetically operated engine valves the gas counter pressures which vary during operation cause irregular fluctuations in the duration of adherence so that, as a result, after deenergizing the holding current, the starting moment of the armature motion varies in a non-predeterminable manner.

Since it is possible, to a large degree of reliability, to determine the moment of armature arrival (impact) in a system having two holding magnets each defining terminal position of the armature, it has been attempted to determine the actual moment of separation by an empirical computation process, based on the moment of impact, as disclosed in published European Patent Application 0 264 706. Such a method, however, is not sufficiently reliable under certain accuracy requirements.

Further, for improving such electromagnetic circuits for operating engine valves, it has been proposed to improve the timing accuracy by increasing the bias of the return means acting in the opening direction, and also, to provide measures for varying the magnetic resistance in the magnetic circuit, as disclosed in published European Patent Application 0 405 189.

SUMMARY OF THE INVENTION

Since neither the mechanical solution disclosed in published European Patent Application 0 405 189 nor the computation methods described in published European Application 0 264 706 meet the accuracy requirements, it is an object of the invention to improve the control of the armature movement for electromagnetic circuits of the above outlined type by means of recognizing the beginning of the armature movement.

This object and others to become apparent as the specification progresses, are accomplished by the invention, according to which, briefly stated, the method of controlling movements of an armature in an electromagnetic circuit which includes at least one holding solenoid applying magnetic forces to the armature and at least one resetting arrangement for applying a resetting force to the armature, includes the following cyclical steps: switching on a holding current to flow through the solenoid for holding the armature at the solenoid; after a predetermined period, switching off the holding current for causing the armature to begin a motion away from the solenoid; after switch-off of the holding current detecting, across the solenoid, a voltage change caused by the displacement of the armature for recognizing a starting moment of armature motion from the solenoid; and deriving a control signal from signals representing the voltage change ascertained in the course of the detecting step.

The above outlined method according to the invention represents a significant improvement as compared to a method which is based on the recognition of the arrival of the armature at the oppositely located holding magnet and calculates backwardly from that moment, because already the very beginning of the armature motion may be recognized in any given engine cycle. The method according to the invention is based on the recognition that after the decay of the energy in the solenoid, the current flow drops to zero therein. It has been unexpectedly found, however, that after stopping the current, a certain voltage can still be measured across the solenoid. This may be explained by the residual eddy currents in the magnet material, which cause an exponentially decreasing magnetic flux which, in turn, generates a voltage proportionate to the flux change. Also, dependent on the magnet material, a residual field strength is established. If now the armature is set in motion, a significant change occurs in the magnetic circuit by virtue of the fact that the air gap abruptly increases compared to the residual air gap. Such an air gap change results in a change of the magnetic flux which, in turn causes an induced voltage. By sensing such a voltage change, particularly the changes in the voltage course, the beginning of the armature motion may be recognized. It is of advantage to abruptly switch off the holding current to initiate the armature motion. This means that no recovery current is permitted which is ensured by disabling the recovery diode parallel to the solenoid and also, the voltage stability of the final stage transistors for the circuit have to be chosen to be very high to ensure that the current flow decays very rapidly in the solenoid. By virtue of the above outlined measures it is possible to maintain as short as possible the duration of armature adherence between the moment of the deenergization of the holding current and the beginning of the armature motion (to be recognized by the method according to the invention).

According to an advantageous feature of the invention at least one extreme value is detected from the voltage changes caused by the armature motion. The changes appearing in the voltage course may be evaluated in different ways since the voltage, because of the decreasing magnetic flux and thus also because of the exponentially decreasing change of the magnetic flux change first drops to a minimum value. Thereafter, because of the armature motion, a stronger magnetic flux change occurs, so that the voltage again increases. Such a passage through a voltage minimum may be detected without difficulty and results in a very good indication as concerns the actual start of the armature movement. Particularly in the presence of an intentionally provided residual magnetic clearance, by virtue of which the control of the duration of magnet adherence is per se reduced, such a method may be utilized for a very accurate determination of the starting moment of the armature movement. In applications which have greater fluctuations of the duration of adherence, the phenomenon is utilized, according to which the voltage generated by the magnetic flux change caused by the armature motion, again rises to a maximum value after passing through a minimum, before it drops entirely to a zero value. In such applications for determining the beginning of the armature motion the maximum voltage value may be determined after the renewed increase of the voltage, because the total level of the residual magnetic flux depends from the order of magnitude of the duration of adherence which negatively influences the time relationship between the recognition of the voltage minimum and the beginning of the armature motion.

According to a further advantageous feature of the invention, in case of two holding magnets defining the respective opposite terminal positions of the armature, the moment of switching on the current for the respective non-holding solenoid is determined as a function of the recognition of the armature movement at the opposite holding magnet. With the aid of the substantially accurate recognition of the beginning of the armature movement made possible by the method according to the invention, for example the moment of switching on the catching current for the other holding magnet may be adapted accurately to the beginning of the armature motion. In this manner a significant energy saving may be achieved. It is to be noted that in case the catching current is switched on too late, the armature could not be reliably captured. Thus, normally, because of operational safety, the catching current must be switched on prematurely. Such a premature establishment of the catching current, however, has the disadvantage that the moving armature is given an excessive kinetic energy which may lead to a chatter or even to a rebounding of the armature from the pole face. In order to prevent a malfunctioning of the system because of a chatter or a rebounding of the armature, the catching current has to remain switched on for a relatively long period after the arrival of the armature. If, on the other hand, the exact moment of the beginning of the armature motion is known, the time period until the switch-on of the catching current as well as the time period until the switchover of the catching current to the holding current may be controlled in a substantially accurate manner.

DESCRIPTION OF THE PREFERRED EMBODIMENTS

Figure 1:
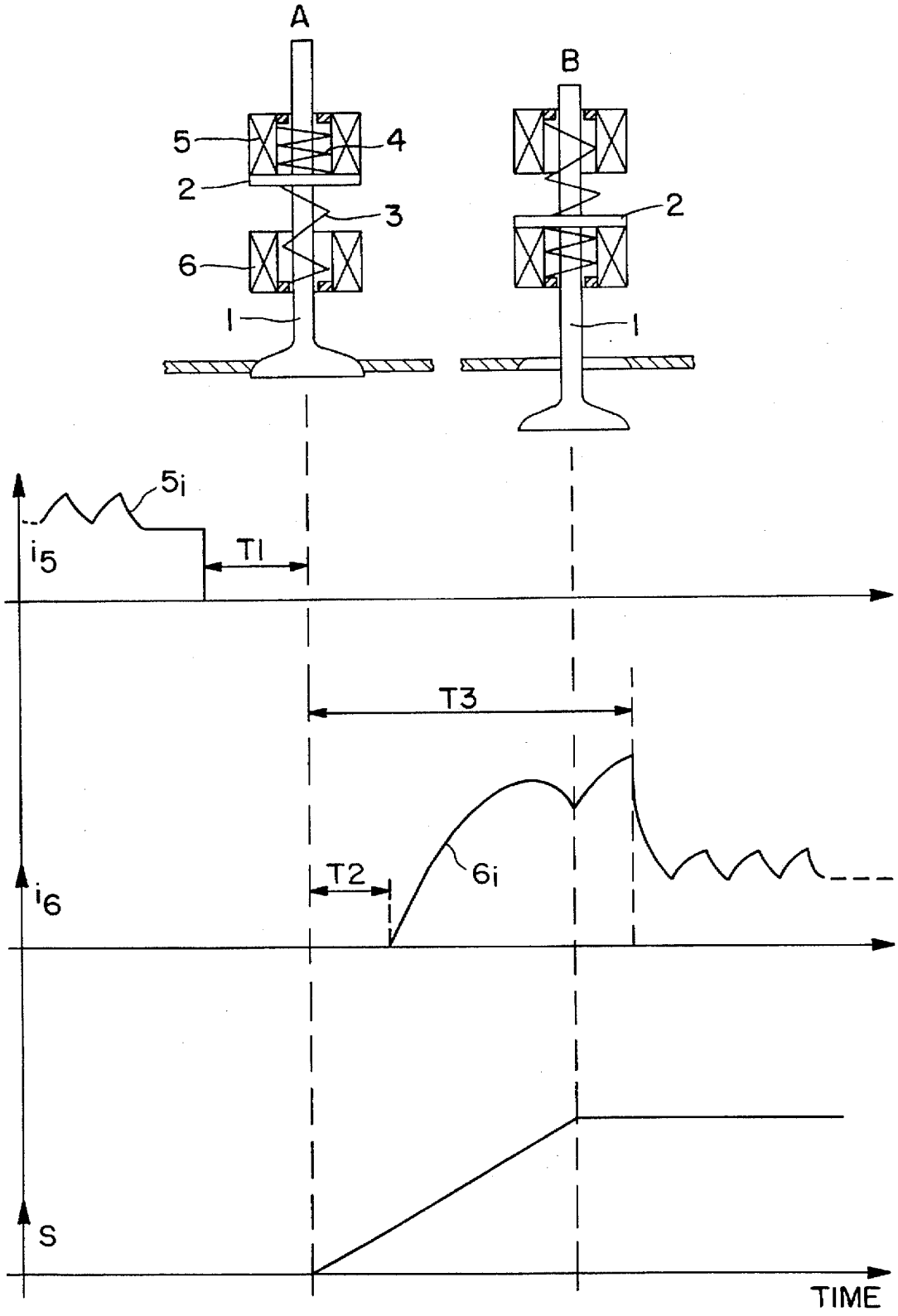
FIG. 1 is a diagram illustrating the current intensity/time function of the solenoid currents as well as the displacement/time function of an armature motion of a gas control valve actuated by an electromagnetic circuit.

FIG. 1 schematically shows an electromagnetically operated gas control valve of conventional structure used in an internal combustion engine. The valve is illustrated in two operational states A and B, showing the valve in its closed and open position, respectively. The valve is essentially formed of a valve body 1 rigidly coupled with an armature 2 which is connected on either side to springs 3 and 4 which serve as resetting means. The armature 2 is further associated with two holding magnets (solenoids) 5 and 6. The holding magnet 5, in the energized state of its solenoid holds the valve 1 in its closed position via the armature 2 as illustrated in state A. When the holding magnet 5 is deenergized and the holding magnet 6 is energized, the armature 2 is moved towards the holding magnet 6 by the force of the biased spring 4 and the increasing magnetic field of the holding magnet 6, so that the valve body 1 is guided into its open position as illustrated in state B.

In an internal combustion engine at least one intake valve and an exhaust valve are provided for each piston so that the gas control valve serving as the gas inlet valve or the gas exhaust valve is operated in the above outlined manner in a cycle determined by the piston motion. In FIG. 1, underneath the closed and opened states A and B of the valve the course of the respective coil current is shown along the associated time axis. In the closed position (state A) the holding magnet 5 is exposed to the holding current **5*i*, so that the valve body 1 is held against its valve seat. To move the valve body into its open position, the holding current 5*i* is interrupted. As determined by the force of the biased spring 4, the armature, together with the valve body 1, starts its motion after a certain duration of adherence (sticking period) T1. After lapse of a certain time period T2 following the beginning of the armature motion, a catching current 6*i* is applied to the holding magnet 6 which serves the purpose of pulling the armature 2 which moves towards the holding magnet 6, into its lower end position until the open state B is reached. As soon as the armature 2 lies against the pole face of the holding magnet 6, the chatter events are terminated, and thus the catching current 6*i* may be reduced to a smaller level, corresponding to the level of the holding current. This event occurs at the end of period T3 running from the moment of deenergization. During this occurrence the holding current, as illustrated by the current curve, is cycled between a lower and an upper level in order to reduce current consumption. If the valve is to be closed again, the holding current flowing through the solenoid of the holding magnet 6 is interrupted, so that the above described motion sequence occurs in a reverse order, that is, the valve, after a renewed duration of adherence, again starts moving and is, in a corresponding manner, caught by the upper holding magnet 5 and is again, after lowering the catching current, held in the closed position by the holding current 5***i*. The motion of the armature 2, together with the valve body 1 is illustrated underneath the two current curves 5*i* and 6*i*.

Figure 2:
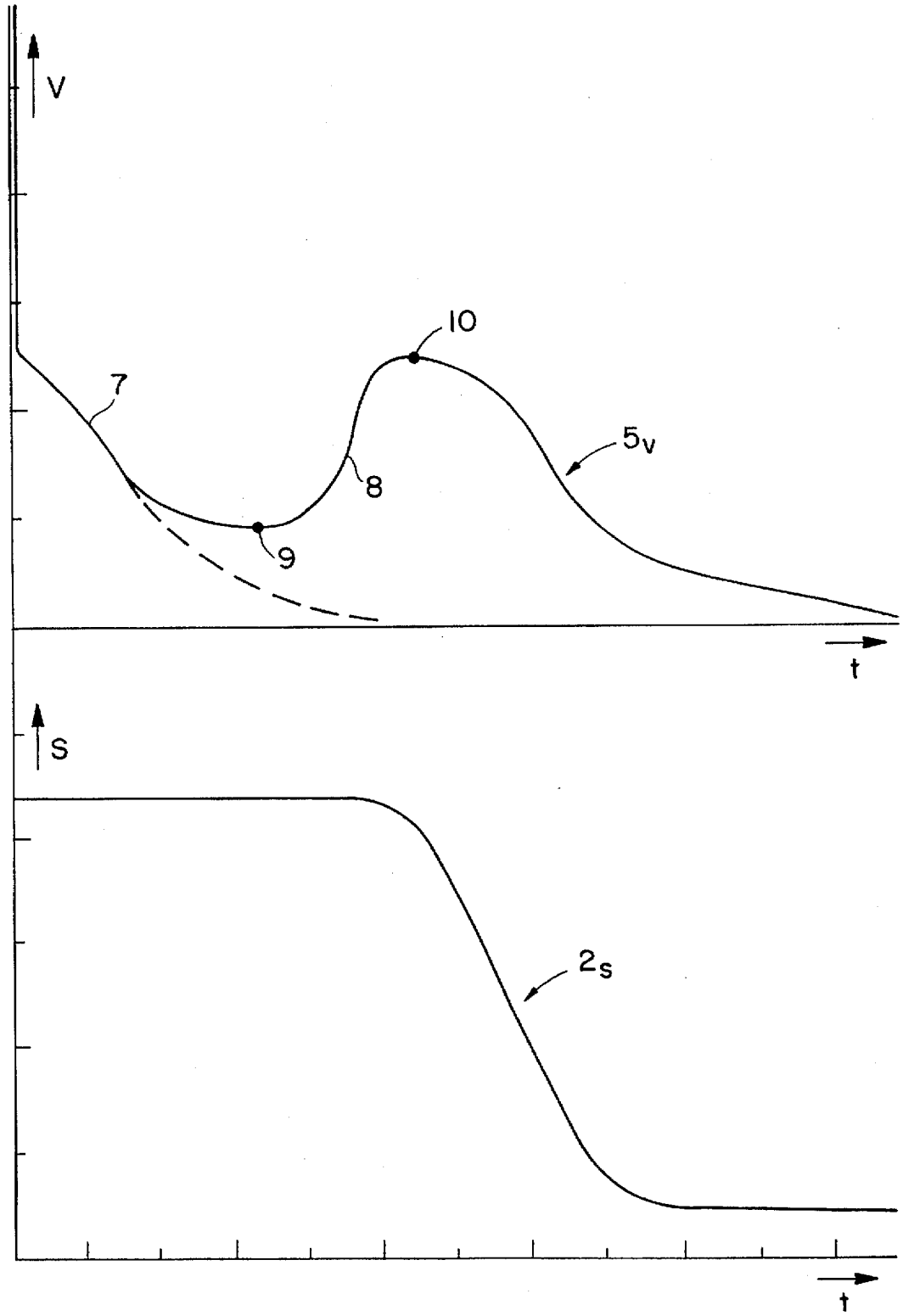
FIG. 2 is a diagram illustrating the voltage and the armature movement as a function of time immediately after deenergization.

FIG. 2 shows, in an enlarged illustration, the course of the voltage 5*v* after stopping the holding current in the solenoid 5 (upper curve) and the displacement/time curve 2*s* of the armature motion.

As it may be recognized from the illustration of the current 5*v*, immediately after stopping the holding current, the voltage decreases at the solenoid as shown by the curve portion 7. If the armature had maintained its position, a voltage course would be obtained as shown in the phantom line continuation of the curve portion 7.

Since, as noted above, by virtue of the armature motion a significant change in the magnetic circuit occurs, particularly by virtue of the fact that the air gap suddenly increases as compared to the residual air gap, a change in the magnetic flux takes place which results in an induced voltage so that the voltage again increases as indicated by the curve portion 8. The inversion point 9 thus yields a very good indication concerning the actual beginning of the armature motion. Since the increase of the voltage is dependent from the armature displacement, such voltage increases up to a maximum value, as indicated at 10 and thereafter decreases to zero.

Figure 3:
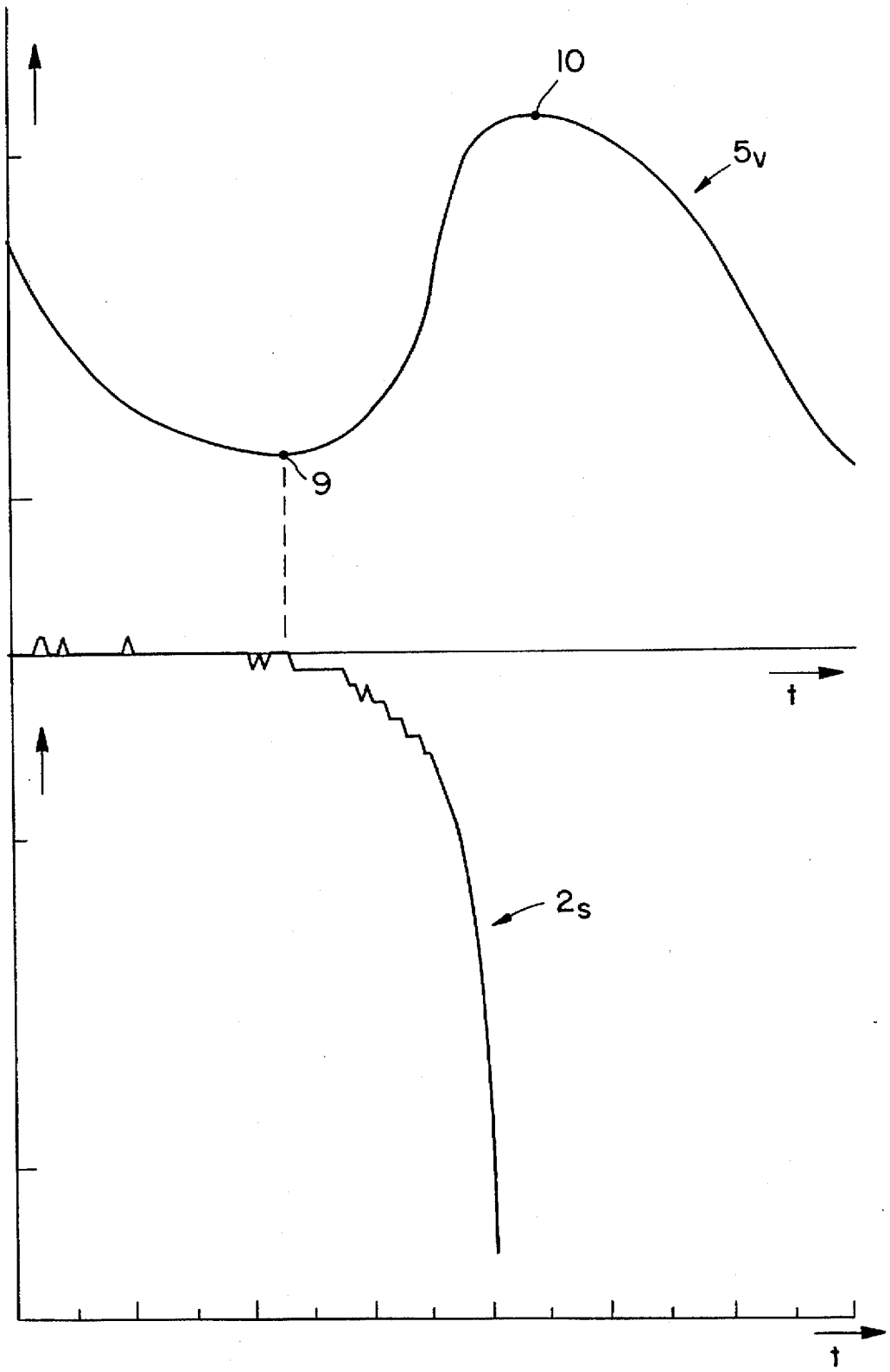
FIG. 3 is an enlarged diagram illustrating the armature motion at the moment of motion start and the course of the associated voltage.

In FIG. 3 the voltage curve 5*v* is shown greatly magnified in the zone of the armature start to the minimum point 9. Measurements have shown that the point 9 of the voltage curve 5*v* represents a very good indication of the actual start of the armature motion.

In case of larger fluctuations of the duration of adherence which may occur particularly in cases where no air gaps are provided or in case of changes of external conditions, for example, changes in the gas counterpressure, the maximum voltage is, upon its renewed increase, determined in point 10 because the total level of the residual magnetic flux is a function of the order of magnitude of the duration of adherence. Accordingly, by determining the voltage 5*v* across the solenoid, the start of armature may be recognized with sufficient accuracy.

Figure 4:
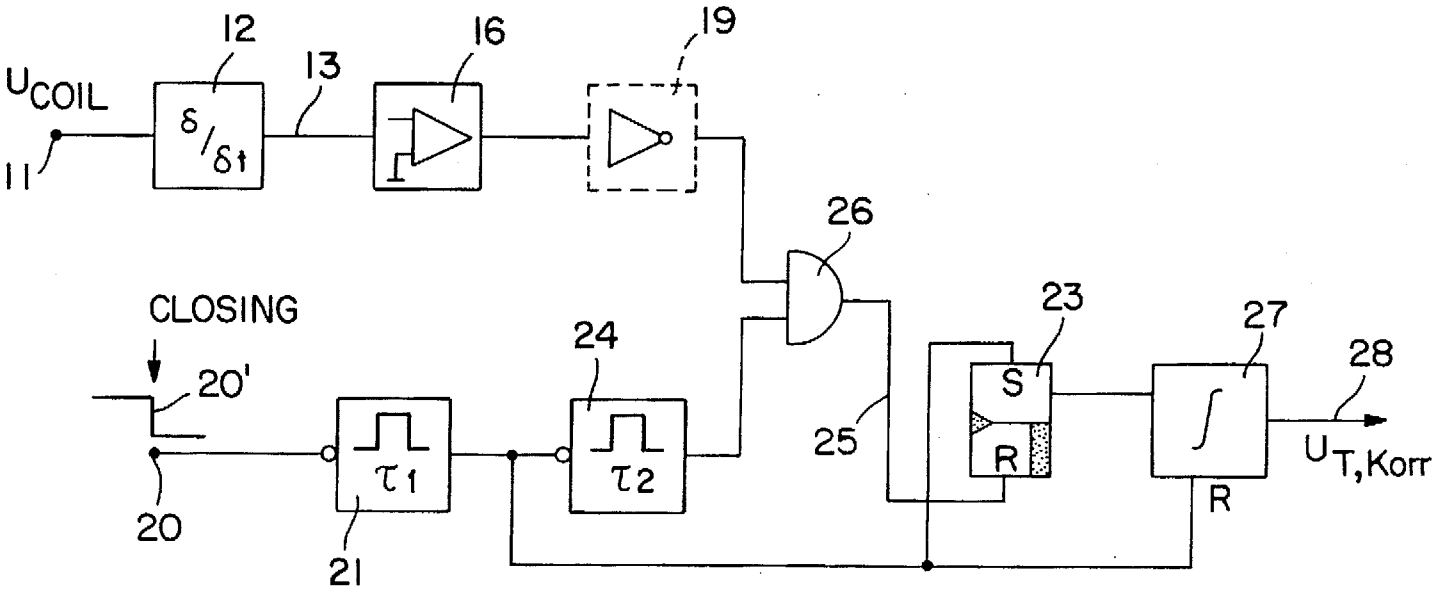
FIG. 4 is an evaluating circuit for detecting the voltage minimum and the voltage maximum.
Figure 5:
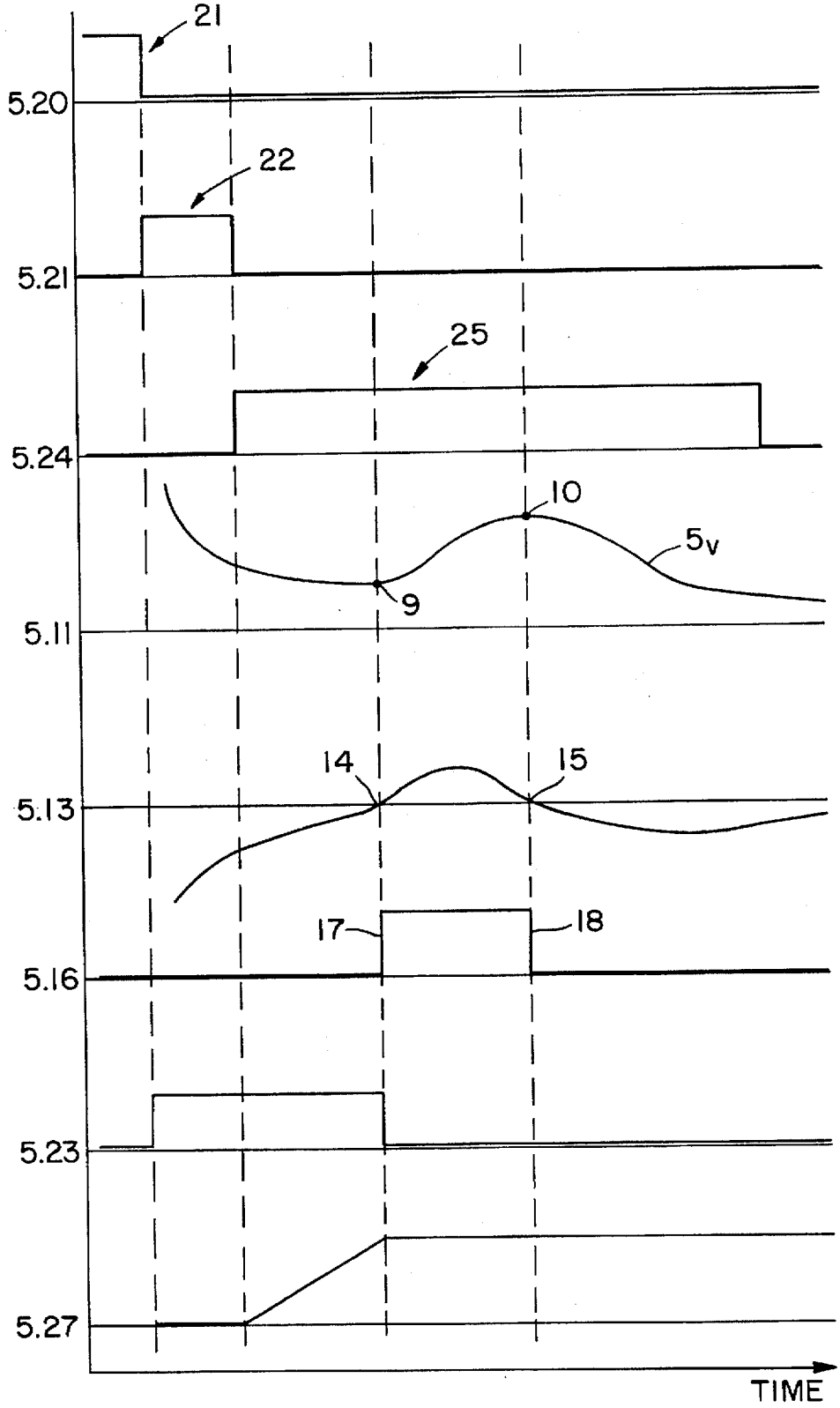
FIG. 5 is a diagram illustrating the course of the individual signals at the circuit elements of the circuit illustrated in FIG. 4.

FIG. 4 illustrates an example of an evaluating circuit. The associated signal curves are illustrated in FIG. 5 and are characterized by the index designating the respective element of the circuit shown in FIG. 4. The voltage 5*v* applied to the input 11 is first differentiated in a differentiator 12 so that maximum and minimum values applied to the input 11 cause zero values 14 and 15 to appear at the output 13 of the differentiator 12. In a comparator 16 connected to the output 13, the zero values 14, 15 of the voltage 5.13 are converted into respective edges 17 and 18 of a digital signal 5.16. Dependent upon the mode of application, the zero passages should be evaluated either from minus to plus (minimum detection) or from plus to minus (maximum detection). In order to adapt the signal edges 15, 16 to requirements, an inverter 19 may be connected to the output of the comparator 16. The time information contained in the flanks 15, 16 is converted into a voltage signal in the successive stage.

At the circuit input 20 the signal edge 20' which switches off of the holding current through the solenoid, triggers a monostable flip-flop 21 which generates a short pulse 22 which sets a flip-flop 23 and further, with its trailing signal edge triggers another monostable flip-flop 24. The latter generates a gate signal 25 which releases the signal of the comparator 16 or the inverter 19 through an AND-gate 26. By means of the time periods predetermined by the monostable flip-flops 21 and 24, the evaluating window (that is, the time slot in which a minimum and/or maximum is effectively detected) for the voltage evaluation may be set.

The output signal of the AND-gate 26 is applied to the resetting input of the flip-flop 23. Upon a detected maximum and/or minimum the flip-flop 23 is thus reset. An integrator 27 connected to the output of the flip-flop 23 integrates the output voltage of the flip-flop 23. In this manner the voltage at the output 28 of the integrator 27 increases with a constant slope as long as the flip flop 23 is set, that is, until a minimum or a maximum is detected. In this manner the voltage obtained at the output 28 is proportional to the time which elapses from the moment of switch-off of the holding current, that is from the setting of the flip-flop 23 until the detection of the minimum, thus, until the beginning of the motion of armature motion which is determined by the resetting of the flip-flop 23. This may be recognized from the time-wise aligned individual signal curves shown in FIG. 5. In the voltage curve 5.11 in FIG. 5 the minimum and maximum points 9 and 10 are illustrated accordingly.

The resetting of the integrator 27 is effected by the output signal of the monostable flip-flop 21 simultaneously with the setting of the flip-flop 23.

The above-described circuit implementation is to be regarded as an example only; other realizations, based, for example, on digital technology, are also feasible.

Also, the evaluation of the voltage is not limited to the methods described in connection with FIGS. 4 and 5 concerning the maximum-minimum recognition, but may be realized on the basis of other criteria considered to be favorable for the application in question. Thus, for example, an average value from a local maximum and minimum voltage may be determined and the point of intersection of the course between the two extreme values may be determined by such average value.

Figure 6:
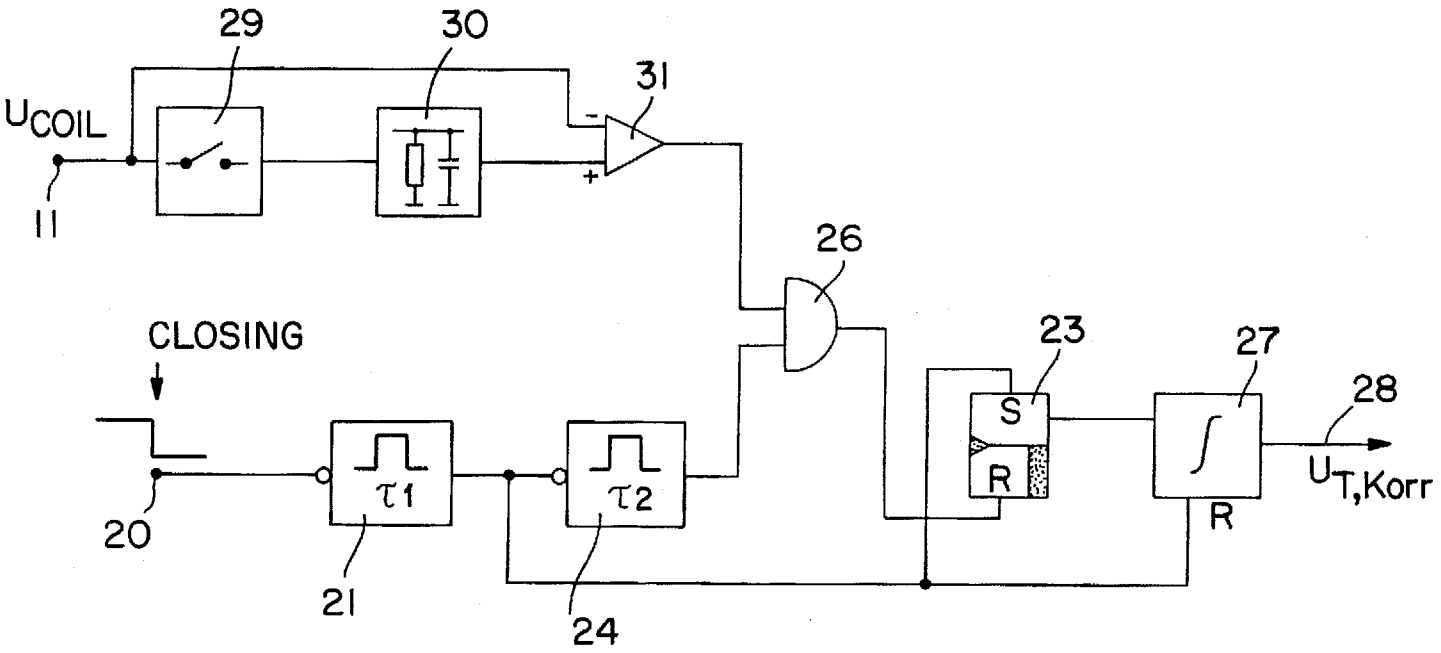
FIG. 6 is a variant of the circuit shown in FIG. 4.

A further possibility for evaluation is the detection of the deviation from the expected exponential course. FIG. 6 illustrates an example of such a procedure. The major part of the circuit shown in FIG. 6 is identical to that of FIG. 4; only the portion for generating the signal edges as a function of the solenoid voltage is altered. Upon appearance of the pulse at the monostable flip-flop 21, a switch 29 is closed and thus brings the capacitor of a short-time integrator 30 to the same level as the input voltage. After opening the switch 29 the capacitor of the short-time integrator 30 discharges across a resistor according to an e-function. The time constant of such e-function and thus the R-C combination must be selected such that the voltage at the capacitor of the integrator 30 during armature engagement is always slightly greater than the input voltage. If now the armature 2 begins its motion, the voltage detected at the input 11 will be greater than the voltage at the capacitor and the comparator 31 switches its output to a high level. The other procedures correspond to those described in connection with FIG. 4.

Figure 7:
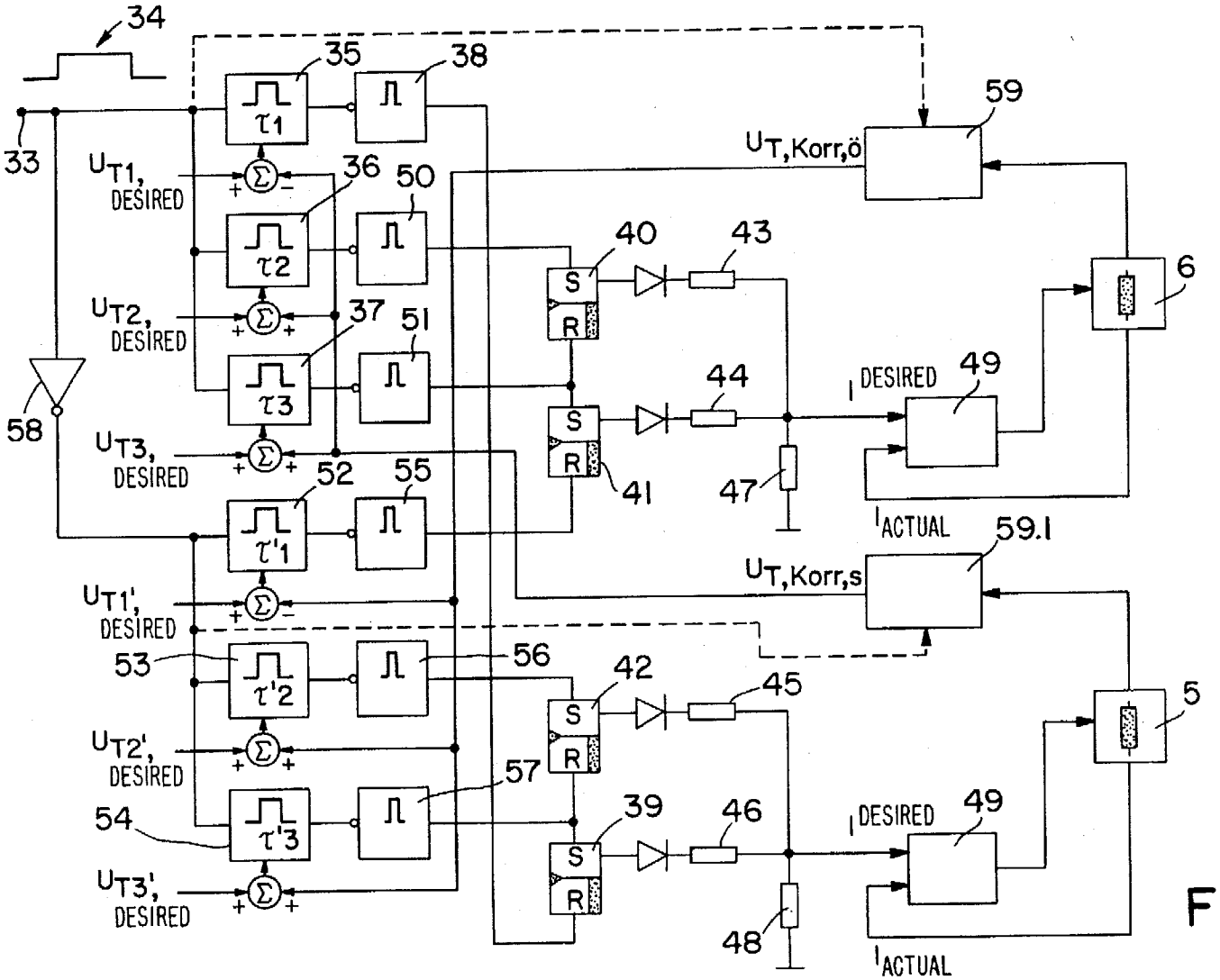
FIG. 7 is a diagram illustrating an electromagnetic circuit including two holding magnets according to the invention.

FIG. 7 is a diagram of a circuit which illustrates the control of the two solenoids 5 and 6 of the example illustrated in FIG. 1 and relates to a gas control valve in an internal combustion engine. To the input 33 a signal 34 is applied whose leading and trailing edges initiate, respectively, the opening and the closing of the valve. The signal 34 triggers three positive edge controlled monostable flip-flops 35, 36 and 37. The positive edge at the input 33 effects the energization of the monostable flip-flop 35 which remains on the high level for the time period $T_1$ and thereafter generates a trailing edge. The trailing edge triggers a monostable flip-flop 38 which is connected to the output of the monostable flip-flop 35 and which generates a pulse of very short duration that resets a flip-flop 39. The outputs of the flip-flops 39, 40, 41 and 42 are used for applying a catching current level or a holding current level for the respective opening or closing solenoids of the valve to be actuated that is, the two solenoids 5 and 6 of the valve shown in FIG. 1. The height of the current level is determined by the resistors 43 through 48, each forming a voltage divider. The resetting of the flip-flop 39 switches off the holding current across the closing solenoid since the desired value for the successive current regulator 49 is set to zero.

Further, by the leading signal edge at the input 33 the monostable flip-flop 36 with a time constant $T_2$ is set. After lapse of the time period $T_2$ the after-connected monostable flip-flop 50 is triggered which generates a short pulse which, in turn, sets the flip-flop 40. In this manner the desired predetermined input signal for the opening current is set to the level of the catching current. The flip-flop 40 is, by means of the monostable flip-flops 37 and 51 again reset for a time $T_3$ after the leading signal edge of the signal at the input 33. At the same time the flip-flop 41 is set. By means of this procedure a switch-over from the catching current to the holding current occurs.

The monostable flip-flops 55 through 57 operate in principle in the same manner on the closing side. The input signal is first, however, guided through an inverter 58 which ensures that the rear edge of the signal at the input 33 is utilized as a time-determining edge. At a moment $T'_1$ after the trailing edge of the input signal (closing flank), the flip-flop 41 is reset by the monostable flip-flops 52 and 55 and thus the current through the opening solenoid 6 is discontinued. By interrupting the current through the opening solenoid 6, the motion of the armature and thus the displacement of the valve are initiated.

In a detector 59 which may contain, for example, a circuit according to FIG. 4, a voltage is generated which is proportionate to the duration of adherence of the valve, that is, it is proportionate to the delay period between the switch-off of the holding current and the beginning of the armature displacement. This value has to be utilized for correcting the delay periods of the monostable flip-flops. In case of a long duration of adherence, the time $T'_1$ has to be reduced so that in the next cycle the shut-off of the holding current may occur sooner. For this purpose the output voltage of the detector 59 is corrected; it is deducted in a summing circuit from an earlier inputted desired value and applied to the monostable flip-flop 52. It is noted that the longer the duration of adherence, the greater the output voltage of the detector 59. The time constant $T'_1$ of the monostable flip-flop 52 is proportionate to the applied voltage so that in the next cycle the switch-off of the holding current by the flip-flop 41 occurs exactly that much earlier as the duration of the adhering period of the valve. In this manner there is achieved a control to obtain a constant delay between the appearance of the signal edge at the input 33 and the actual start of armature motion. The desired delay value may be inputted by means of the voltage input $U_{T1des}$.

The output voltage of the detector 59 is furthermore used to correct the time constants $T'_2$ and $T'_3$ which determine the switch-on of the catching current and the holding current on the opposite side. The later the start of the armature motion at the opening solenoid 6, the greater the output voltage of the detector 59. This voltage is added to a preinputted desired value $U_{T2'des}$ or $U_{T3'des}$ and in each instance it is applied to the monostable flip-flops 53 and 54 as time-determining voltages. As a result, at a later motion start, the time constants $T'_2$ and $T'_3$ are also extended and, accordingly, the switch-on of the catching current and the switch-over to the holding current occur correspondingly later, in an exact adaptation to the motion of the armature. The voltages $U_{T1des}$ to $U_{T3des}$ may thus be either predetermined as fixed values or, as required, may be dependent from the operational point, for example they may be predetermined by an engine control device.

Other embodiments of the entire process may also be realized in which, for example, after the turn-off phase of the current, when the voltage in the solenoid has dropped below a predetermined value, a current is applied to the solenoid. Such a current has to be necessarily smaller than the holding current which is required for holding the armature. If a negative current is selected then, as a particular advantage, a more rapid decay of the magnetic field may be achieved and thus the duration of adherence may be reduced. This effect, however, is limited by the generation of additional eddy currents.

The applied current generates an additional magnetic flux, as a result of which motions of the armature may be registered for a longer period after the armature is dropped. By an appropriate design of the magnetic circuit and the moved components motions can thus be recognized which lie in the phase of the highest armature velocity and thus permit a very accurate time allocation.

It is to be understood that the system according to the invention is not limited to the above-described example for an electromagnetic actuation of a gas control valve in an internal combustion engine but may find application in electromagnetic switching devices where only a single holding magnet is present. Thus, the invention may find application in gas control valves in which, for example, a spring assumes the closing function and a holding magnet assumes the opening function. In such an arrangement too, the duration of adherence of the armature is of significance because for introducing the closing function for the switch-off of the holding current the detection of the duration of adherence is of significance in order to effect a timely closing of the valve.

The method according to the invention also permits a function control because a significantly delayed or omitted armature motion is also recognized and thus a corresponding setting signal may be generated.

It will be understood that the above description of the present invention is susceptible to various modifications, changes and adaptations, and the same are intended to be comprehended within the meaning and range of equivalents of the appended claims.

What is claimed is:

1. A method of generating a control signal as a function of a moment of motion start of an armature in an electromagnetic circuit including at least one holding solenoid applying magnetic forces to the armature and at least one resetting means for applying a resetting force to said armature, comprising the following cyclical steps:

(a) switching on a holding current to flow through said solenoid for holding the armature at said solenoid;

(b) after a predetermined period following step (a), switching off the holding current for causing the armature to begin a motion away from the solenoid in response to a force exerted by said resetting means;

(c) after step (b), detecting, across the solenoid, a voltage change caused by the displacement of the armature for recognizing a starting moment of armature motion from the solenoid; and (d) deriving a control signal from signals representing the voltage change detected in step (c).

2. The method as defined in claim 1, wherein step (c) further comprises the step of detecting at least one extreme value of the changing voltage.

3. A method of controlling movements of an armature between two end positions in an electromagnetic circuit including two solenoids at respective said end positions for applying magnetic forces to the armature for causing the armature to be held in one end position for a predetermined period and thereafter allowing motion of the armature towards the other of said end positions; the solenoid adjoining the end position where the armature actually dwells and from which it moves being a momentarily holding solenoid and the solenoid opposite the momentarily holding solenoid being a momentarily non-holding solenoid; further including resetting means for applying a resetting force to the armature for moving the armature away from the end position where the armature is momentarily situated; the method comprising the following cyclical steps:

(a) switching on a current to flow through the momentarily holding solenoid for holding the armature;

(b) after a predetermined period following step (a), switching off the current for causing the armature to begin a motion from the momentarily holding solenoid towards the momentarily non-holding solenoid in response to a force exerted by said resetting means;

(c) after step (b), detecting, across the momentarily holding solenoid, a voltage change caused by the displacement of the armature for recognizing a starting moment of armature motion from the momentarily holding solenoid;

(d) deriving a control signal from signals representing the voltage change detected in step (c);

(e) determining a moment for switching on a current in the momentarily non-holding solenoid as a function of the starting moment of armature motion determined in step (c); and (f) switching on a current in the momentarily non-holding solenoid at a moment determined in step (e).

4. The method as defined in claim 3, further comprising the steps of (g) maintaining the current initiated in step (f) at a first current level; and (h) switching over from the first current level to a second current level at a switch-over moment; said second current level being lower than said first current level; and (i) determining said switch-over moment as a function of the starting moment of armature motion determined in step (c).

5. A method of controlling movements of an armature in an electromagnetic circuit including at least one holding solenoid applying magnetic forces to the armature and at least one resetting means for applying a resetting force to said armature, comprising the following cyclical steps:

(a) switching on a holding current to flow through said solenoid for holding the armature at said solenoid;

(b) after a predetermined period following step (a), switching off the holding current for causing the armature to begin a motion away from the solenoid in response to a force exerted by said resetting means;

(c) after step (b), detecting, across the solenoid, a voltage change caused by the displacement of the armature for recognizing a starting moment of armature motion from the solenoid;

(d) deriving a control signal from signals representing the voltage change detected in step (c);

(e) determining a moment for switching on a current in the momentarily non-holding solenoid as a function of the starting moment of armature motion determined in step (c); and (f) switching on a current in the momentarily non-holding solenoid at a moment determined in step (e).

* * * * *